United States Patent [19]

Maldonado

[11] 3,976,294

[45] Aug. 24, 1976

[54] GAME TABLE

[76] Inventor: Damian G. Maldonado, 1808 Jenning St., Mendota, Calif. 93640

[22] Filed: May 12, 1975

[21] Appl. No.: 576,551

[52] U.S. Cl. ..... 273/3 A; 273/123 R

[51] Int. Cl.[2] ..... A63D 15/00

[58] Field of Search ..... 273/3, 12, 85 D, 123 R, 273/123 A, 125 R, 125 A; D34/3

[56] References Cited

UNITED STATES PATENTS

| | | | |
|---|---|---|---|
| 289,217 | 11/1883 | Calder | 273/3 A |
| 3,870,303 | 3/1975 | Patterson, Jr. | 273/85 D |

FOREIGN PATENTS OR APPLICATIONS

| | | | |
|---|---|---|---|
| 9,410 | 4/1907 | United Kingdom | 273/3 A |
| 20,735 | 9/1907 | United Kingdom | 273/3 A |

*Primary Examiner*—Paul E. Shapiro
*Attorney, Agent, or Firm*—Huebner & Worrel

[57] ABSTRACT

An improved game table of an oblong configuration having a planar surface on which is played a game requiring small balls to be driven against one another, through the manipulation of a cue, for depositing selected balls in predetermined pockets communicating with the surface. The surface is a substantially rigid, fabric-covered playing surface disposed in a substantially horizontal plane and defined by a pair of side rails extended in spaced parallelism along the side edge surfaces of the playing surface and a pair of end rails extended in spaced parallelism across the ends of the playing surface. Each of the rails has included therein, near the midportion thereof, a pocket substantially bisected by an axis of symmetry for the table, whereby the table includes four pockets and is devoid of corner pockets, for thus increasing the level of difficulty of games played on the table.

4 Claims, 5 Drawing Figures

GAME TABLE

BACKGROUND OF THE INVENTION

1. Field of the Invention

The invention generally relates to game tables, and more particularly to a game table on which is played a game, herein referred to as pool, requiring small billiard-like balls, herein referred to as pool balls, to be driven one against another, through a manipulation of a cue, for depositing, herein referred to as "making", selected balls in predetermined receptacles, herein referred to as pockets.

2. Description of the Prior Art

The prior art, of course, includes numerous types of tables on which is played billiards and games of a similar nature. However, a family of games, collectively referred to as pool, normally requires the use of tables having six pockets, two of which are referred to as "side pockets" and are disposed within the midportions of the side rails, while the other four pockets are located in the four corners defined at the intersection of the rails and are referred to as "corner pockets".

As can be appreciated by those familiar with pool tables having both side and corner pockets, the level of skill required to cause selected balls to be made in six pockets, including corner pockets, is substantially less than the skill required to make the balls in side pockets, alone.

This coupled with the fact that many players are particularly skilled at making balls in the corner pockets tends to reduce the challenge of the game and thus the rate of incidence of play.

Attempts have been made to increase the difficulty of pool-like games by providing pockets with "live" corner cushions, such as are found on tables referred to as "snooker tables" and the like. However, the problem of increasing the level of difficulty of pool and similar games for thus increasing the challenge of the play thereof continues to plague those familiar with the play of such games.

It is, therefore, the general purpose of the instant invention to provide an improved pool table having pockets so arranged as to increase the level of difficulty and the attendant challenge of billiard-like games including the game of pool, as currently played or as modified, and thus enhance the desirability of play.

OBJECTS AND SUMMARY OF THE INVENTION

It is, therefore, an object of the instant invention to provide an improved game table which overcomes the aforementioned difficulties and disadvantages.

It is another object to provide an improved pool table.

Another object is to provide an improved pool table having pockets so arranged as to increase the level of difficulty of play for the family of billiard-like games known as pool.

It is another object to provide an improved pool table havig pockets arranged only along both axes of symmetry thereof, with the corners defined by the rails thereof being configured to avoid entrapping balls.

It is another object to provide an improved table of an oblong configuration on which is played a game requiring small billiard-like balls to be driven one against another through a manipulation of a cue for depositing selected balls in predetermined pockets, the pockets being substantially bisected by orthogonally related axes of symmetry for the table.

These together with other objects and advantages will become more readily apparent by reference to the following description and claims in light for the accompanying drawings.

DESCRIPTION OF THE PREFERRED EMBODIMENT

Figure 1:
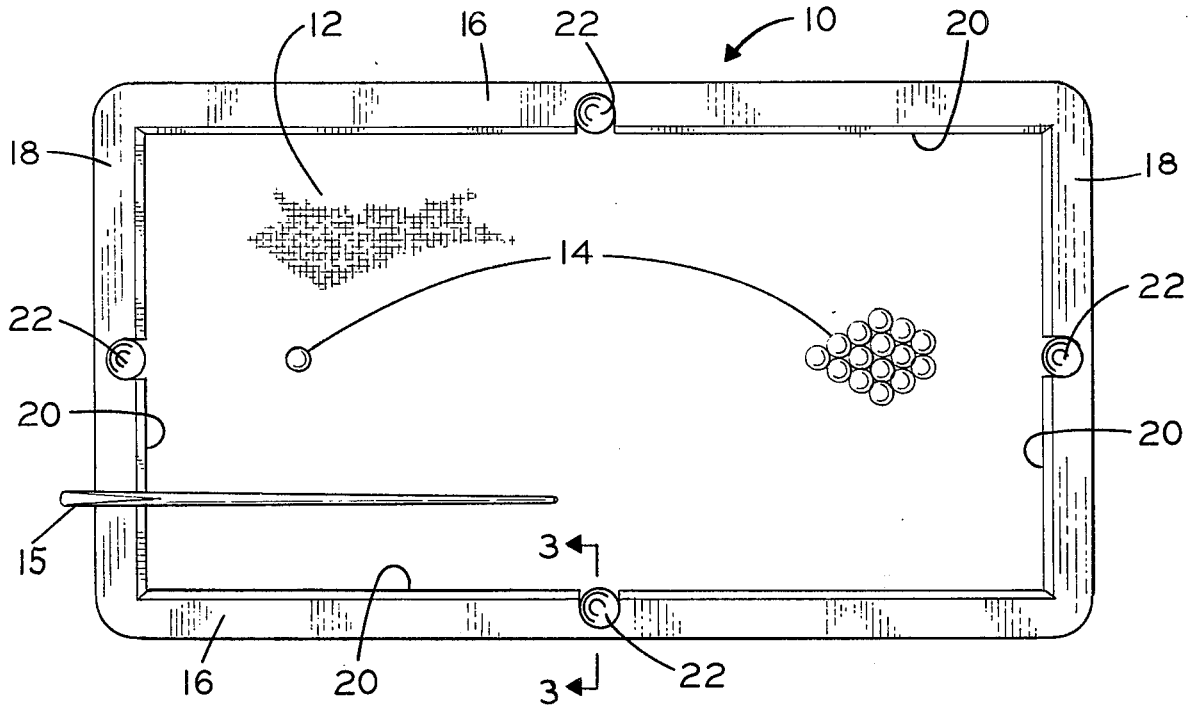
FIG. 1 comprises a top plan view of an improved pool table which embodies the principles of the instant invention.

Referring now to the drawings wherein like reference characters designate like or corresponding parts throughout the several views, there is shown in FIG. 1 a top plan view of a pool table, generally designated 10, which embodies the principles of the instant invention.

The table 10, as shown, includes a substantially rigid, fabric-covered playing surface 12 upon which pool balls 14 are caused to roll freely in response to being struck by a cue, designated 15, or by other balls. The playing surface 12 is of an oblong configuration and includes a pair of side rails 16 disposed in mutual parallelism, extended along the opposite sides of the playing surface. Extended transversely of the playing surface 12, across the opposite ends thereof, there is a pair of end rails 18, the longitudinal axes of which intersect with those of the rails 16 to establish corners. As can be appreciated by those familiar with tables upon which is played the family of games, known as pool, the rails 16 and 18 are slightly elevated with respect to the playing surface 12 and include cushions 20 extended therealong in juxtaposition with the playing surface. Of course, the function of the cushions 20 is to cause the balls 14 to rebound toward the center of the table upon striking the cushion.

The table 10 embodying the instant invention is characterize by four pockets, designated 22, each of which opens toward the playing surface and is substantially bisected by an axis of symmetry for the table 10. Thus, each of the pockets 22 is disposed within the midportion of one of the rails 16 and 18. Thus, the table 10 includes four side pockets and no corner pockets.

Figure 2:
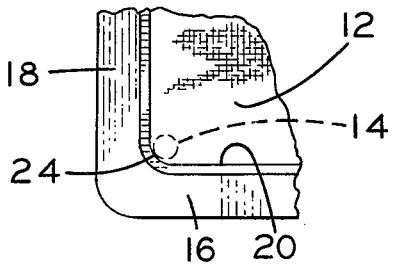
FIG. 2 is a fragmented top plan view of a modified embodiment of the invention.

In order to avoid entrapping the balls 14 within the corners, an embodiment of the invention includes a slightly arcuate cushion segment, designated 24, FIG. 2, formed by arcuate segments of the cushions mounted on the intersecting rails. Thus, it is practically impossible to entrap a ball 14 within the corner.

Figure 4:
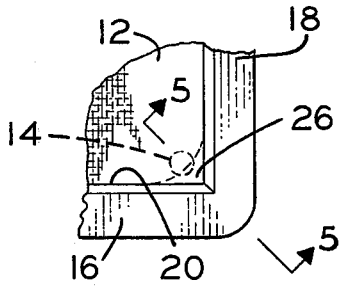
FIG. 4 is a fragmented top plan view of still another embodiment of the invention.
Figure 3:
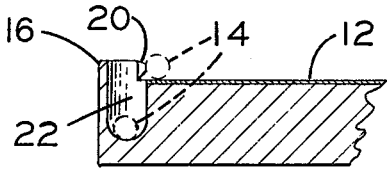
FIG. 3 is a cross-sectional view taken generally along line 3—3 of FIG. 1.
Figure 5:
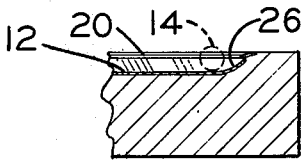
FIG. 5 is a cross-sectional view taken generally along line 5—5 of FIG. 4.

Alternatively, where so desired, the surface of the table 10 may, as illustrated in FIGS. 4 and 5, be inclined downwardly, toward the center of the table, within the areas of the corners, thus to provide sloping surface segments 26 which also serve to assure that no ball 14 will come to rest within a corner defined by the rails 16 and 18.

It is to be understood that the table 10 which embodies the principles of the instant invention can be employed in playing a wide variety of games which require billiard balls, or pool balls, to be driven against one another through a manipulation of a cue. Therefore, the particular rules of a game played on the table 10 may be as desired. However, it should be apparent that any game played on the table 10 is restricted to a use of four pockets, each of which is substantially bisected by an axis of symmetry for the table thus deleting a use of corner pockets.

In view of the foregoing, it should be apparent that the table 10 which embodies the principles of the instant invention provides a practical solution to the problem of increasing the level of difficulty of games, such as pool, played with small balls and a cue requiring the balls to be deposited in predetermined pockets.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters patent is:

1. An improved pool table of an oblong, substantially rectangular configuration on which is played a game requiring small balls to be driven one against another through a manipulation of a cue, consisting of:

a substantially rigid, uninterrupted fabric-covered playing surface disposed in a substantially horizontal plane, a first pair of elevated rails extended in spaced parallelism along opposite sides of said surface, and a second pair of elevated rails extended in spaced parallelism across the opposite ends of the surface in orthogonal intersecting relation with said first pair of rails, precisely four pockets defined at the midportions of said rails and disposed in direct communication with said surface and substantially bisected by orthogonally related axes of symmetry for said surface, and a rebound cushion extended along said rails between said pockets.

2. The pool table of claim 1 wherein said cushion defines four corners of right-angular configurations disposed in spaced relation with said pockets.

3. The table of claim 2 wherein the surface of the table near said corners is inclined downwardly away from the cushion.

4. The table of claim 1 wherein said cushion defines four corners of arcuate configurations disposed in spaced relation with said pockets.

* * * * *

UNITED STATES PATENT AND TRADEMARK OFFICE

CERTIFICATE OF CORRECTION

PATENT NO. : 3,976,294

DATED : August 24, 1976

INVENTOR(S) : Damian G. Maldonado

It is certified that error appears in the above-identified patent and that said Letters Patent are hereby corrected as shown below:

Column 2, Line 47,

At the end of line 47, delete "characterize" and insert --- characterized ---.

Column 3, Line 9,

Before "corner" and after "pockets" insert quotation marks.

Signed and Sealed this

Second Day of November 1976

[SEAL]

*Attest:*

RUTH C. MASON
*Attesting Officer*

C. MARSHALL DANN
*Commissioner of Patents and Trademarks*